US009243438B2

(12) United States Patent
Busch

(10) Patent No.: US 9,243,438 B2
(45) Date of Patent: Jan. 26, 2016

(54) METHOD FOR THE ARRANGEMENT OF A DRIVE UNIT AT A CEILING ELEMENT OF A REVOLVING DOOR

(71) Applicant: Sven Busch, Dortmund (DE)

(72) Inventor: Sven Busch, Dortmund (DE)

(73) Assignee: Dorma Deutschland GmbH, Ennepetal (DE)

( * ) Notice: Subject to any disclaimer, the term of this patent is extended or adjusted under 35 U.S.C. 154(b) by 0 days.

(21) Appl. No.: 14/153,933

(22) Filed: Jan. 13, 2014

(65) Prior Publication Data

US 2014/0196373 A1 Jul. 17, 2014

(30) Foreign Application Priority Data

Jan. 14, 2013 (DE) ..... 10 2013 000 419

(51) Int. Cl.
*E05F 15/10* (2006.01)
*E06B 3/90* (2006.01)
*E05F 15/608* (2015.01)

(52) U.S. Cl.
CPC ..... *E05F 15/106* (2013.01); *E05F 15/608* (2015.01); *E06B 3/90* (2013.01); *E05Y 2900/132* (2013.01)

(58) Field of Classification Search
CPC ..... E05Y 2900/132; E06B 3/90; E06B 11/08; E05F 15/106
USPC ..... 49/42–47
See application file for complete search history.

(56) References Cited

U.S. PATENT DOCUMENTS

| | | | | | |
|---|---|---|---|---|---|
| 3,766,686 | A * | 10/1973 | Sheckells | 49/43 |
| 4,341,165 | A * | 7/1982 | Calandritti et al. | 109/8 |
| 4,458,447 | A * | 7/1984 | Heise et al. | 49/44 |
| 4,627,193 | A * | 12/1986 | Schwarz | 49/42 |
| 4,763,053 | A * | 8/1988 | Rabe | 318/400.41 |
| 4,874,975 | A * | 10/1989 | Hertrich | 310/186 |
| 5,773,943 | A * | 6/1998 | Andersen | 318/432 |
| 5,825,901 | A * | 10/1998 | Hisey | 381/165 |
| 6,266,922 | B1 * | 7/2001 | Rockenbach | 49/42 |
| 8,136,297 | B2 * | 3/2012 | Bzorgi | 49/43 |
| 2008/0047200 | A1 * | 2/2008 | Krause et al. | 49/31 |
| 2009/0188166 | A1 * | 7/2009 | Taheri et al. | 49/31 |
| 2009/0189560 | A1 * | 7/2009 | Taheri et al. | 318/445 |
| 2009/0206777 | A1 * | 8/2009 | Taheri et al. | 318/15 |
| 2012/0005961 | A1 | 1/2012 | Busch et al. | |

FOREIGN PATENT DOCUMENTS

| | | | |
|---|---|---|---|
| DE | 197 11 460 | A1 | 11/1997 |
| DE | 10 2010 024 108 | A1 | 12/2011 |
| EP | 2 072 737 | A2 | 6/2009 |

* cited by examiner

*Primary Examiner* — Katherine Mitchell
*Assistant Examiner* — Justin Rephann
(74) *Attorney, Agent, or Firm* — Cozen O'Connor

(57) ABSTRACT

A method for arranging a drive unit in a revolving door, the drive unit being arranged at a ceiling element of the revolving door and configured to drive a turnstile of the revolving door, includes: arranging a receiving vessel at the underside of the ceiling element so as to form, at an underside of the ceiling element, an installation cavity opening in a direction of an installation space of the turnstile; and inserting a flat-cylindrical, electronically commutated multipole motor into the installation cavity to form the drive unit.

6 Claims, 3 Drawing Sheets

METHOD FOR THE ARRANGEMENT OF A DRIVE UNIT AT A CEILING ELEMENT OF A REVOLVING DOOR

BACKGROUND OF THE INVENTION

1. Field of the Invention

The present invention is directed to a method for the arrangement of a drive unit in a revolving door, wherein the drive unit is arranged at a ceiling element of the revolving door and serves to drive a turnstile of the revolving door.

2. Description of the Related Art

EP 2 072 737 A2 shows an arrangement of a drive unit in a revolving door, wherein the drive unit is arranged at a ceiling element of the revolving door. The drive unit is arranged above the ceiling element and accordingly requires considerable installation space above the revolving door, which is undesirable in modern building facades with revolving doors. A further drawback is that it is necessary to seal the drive unit against climatic influences because the box-shaped installation space above the revolving door for receiving the drive unit can be at least partly exposed to atmospheric conditions so that costly sealing steps are required.

In the course of building renovations, entranceways are often replaced by installing new facades, sometimes with large-area glass elements, and existing revolving doors must often also be renovated at very high costs because no possibility exists for replacing a large drive unit having a space-intensive ceiling-mounted design with more modern drive units.

In particular, for structural reasons it is often impossible to remove a ceiling-mounted drive unit of an old revolving door and retrofit the revolving door with a floor-side drive unit for continued operation. This basically requires an underfloor installation space which cannot be retroactively incorporated in a building or, if so, only at a prohibitive expense.

A drive unit, such as is known from DE 197 11 460 A1, also cannot be realized in every revolving door in principle. The drive, which is integrated in the turnstile, also has a motor and a gear unit, but the revolving door must have considerable dimensions in order to transfer a drive unit provided above a ceiling element of the revolving door to the turnstile of the revolving door as is shown in DE 197 11 460 A1.

DE 10 2010 024 108 A1 shows a revolving door with a floor-side drive unit that also requires a relatively large receiving box for underfloor mounting of the flat, disk-shaped drive unit which is constructed as a multipole motor. Although the installation height of the multipole motor may be limited to the height of the top layer, which is formed by a screed, for example, this installation step can also not be realized in basically any revolving door.

SUMMARY OF THE INVENTION

It is therefore an object of the invention to suggest a method for the arrangement of a drive unit in a revolving door, which can be ceiling-mounted and in particular can be retrofitted in an existing drive unit.

This object is met proceeding from a method for the arrangement of a drive unit in a revolving, wherein the drive unit is arranged at a ceiling element of the revolving door and serves to drive a turnstile of the revolving door. The method includes at least the step of arranging a receiving vessel at the underside of the ceiling element so that an installation cavity, which opens in direction of the installation space of the turnstile, is formed at the underside of the ceiling element, and at least including the step of inserting a flat-cylindrical, electronically commutated multipole motor into the installation cavity to form the drive unit.

The invention proceeds from the idea of mounting a low-profile, dish-shaped or disk-shaped multipole motor at the underside of the ceiling element. To this end, according to one aspect, the invention first provides an installation cavity opening downward in direction of the installation space of the turnstile. According to one aspect of the invention, a receiving vessel is initially secured to the underside of the ceiling element for this purpose.

A receiving vessel, according to an aspect of the present invention, is formed by any dish-shaped, plate-shaped, annular or rectangular element that is suitable for providing at the underside of the ceiling element an installation cavity opening in direction of the installation space of the turnstile. The installation space is dimensioned so as to be suitable for receiving the flat-cylindrical, electronically commutated multipole motor.

Due to its constructional shape, the multipole motor offers the advantage that the turnstile can be gearlessly arranged at the multipole motor without requiring further space. According to an aspect of the invention, the multipole motor can have a disk-shaped or cup-shaped stator part, which can be arranged at the receiving vessel, and the multipole motor can have a disk-shaped or cup-shaped rotor part which can be gearlessly connected to the turnstile of the revolving door. The stator part and the rotor part are in a plane-parallel arrangement with respect to one another, and the rotor part is rotatably supported at the stator part. Consequently, as an additional function, the multipole motor forms the ceiling-side bearing of the turnstile of the revolving door.

Multipole motors are also known as torque motors and have coil elements arranged on a circular path and in an oppositely facing relationship to magnet elements also arranged on a circular path, and the coil elements and the magnet elements are arranged between the rotor part and the stator part.

The multipole motor according to an aspect of the invention can have a particularly flat construction and, as a result of the disk-shaped base structure of the multipole motor, a kind of rotary disk is formed, which can be arranged in an extremely precise manner between the ceiling element and the turnstile of the revolving door.

In a particularly advantageous manner, according to one aspect, the ratio of height to diameter of the substantially round, flat base structure of the electronically commutated multipole motor can be at least 1:3, preferably at least 1:4, particularly preferably at least 1:5, and most preferably 1:8 or more. The ratio of height to diameter is given by the parallel spacing of the disk-shaped or cup-shaped stator part in relation to the disk-shaped or cup-shaped rotor part of the multipole motor to the diameter of the stator part and/or rotor part. The ratios of height to diameter of up to 1:8 or more can only be achieved in that the coil elements and magnet elements are arranged between the stator part and rotor part, and it has been shown that even base structures of multipole motors reaching a ratio of height to diameter of more than 1:12 can be used as drives for revolving doors. The flat, disk-shaped constructional form of the multipole motor has the positive effect that a high torque, which is also necessary for the operation of a revolving door, can be achieved because the circumferential air gap radius between the coil elements and the magnet elements can be very large, particularly when the multipole motor is constructed as an external rotor. In this connection, the rotor part of the multipole motor carries out the same rotational movement as the turnstile of the revolving door and, with regard to the installation space between the turnstile and the ceiling element of the revolving door, there is substantially no limit imposed on the diameter of the multipole motor, and the multipole motor with a greater torque requirement can also have a greater diameter without requiring structural modifications.

According to one aspect, the receiving vessel can be configured in such a way and so arranged at the ceiling element of the revolving door that the multipole motor can be recessed at least partially, for example, also completely, into the ceiling element. Ceiling elements are often formed of wood constructions, profiled metal tube constructions or combinations thereof. The multipole motor can have a height of only 40 mm, for example, so that existing ceiling elements need not be built up to a greater height. In an advantageous manner, it is also possible that the receiving vessel projects some distance out of the underside of the ceiling element so that under ceiling elements can be mounted on the receiving vessel beneath the ceiling element as will be described later.

According to another aspect, the method according to the invention for the arrangement of a drive unit in a revolving door can be preceded by the step of dismantling an existing drive unit with motor and gear unit from the revolving door in which the drive unit is arranged on top of the ceiling element. By dismantling an old drive unit, a facade of a building can be renovated and in particular modernized, in which case it is generally desirable to outfit a revolving door with a very narrow ceiling unit. It is only by virtue of the method according to the invention for retroactive installation of a flat-cylindrical, electronically commutated multipole motor that this advantage can be actualized in a simple manner.

In another aspect, the method can further include the step of arranging under ceiling elements on the underside of the ceiling element. In particular, the method can be further developed through the step of securing the under ceiling elements to a collar-shaped circumferential edge of the receiving vessel. In particular, a harmonious appearance of the ceiling of the revolving door can be achieved in this way when the under ceiling elements are aligned flush with the edge of the receiving vessel. At the same time, the receiving vessel according to the invention offers the advantageous possibility of arranging the under ceiling elements in a simple manner under a supporting ceiling element without structural modification of the latter.

In another aspect, the method according to the invention can be expanded through the step of arranging the turnstile at the multipole motor. In particular, the turnstile can be arranged gearlessly and, according to a first embodiment, the multipole motor can have a disk-shaped or cup-shaped rotor part having an outer surface at which revolving wings of the turnstile can be arranged directly. Further, it is possible to construct the multipole motor with an output shaft at which the turnstile can be arranged also in a simple manner, for example, with an adapter element.

According to another aspect, the method can further include the step of connecting at least one electric lead to the turnstile. Sensor elements may be present in the turnstile, particularly for sensing collisions of the turnstile with persons passing through the revolving door. To this end, a swiveling feedthrough can be provided in the multipole motor so that the electric lead is divided into a portion that rotates along with the turnstile and the rotor part of the multipole motor and another portion arranged in a stationary manner particularly at the stator and accordingly provided inside the multipole motor. Further, a control unit can be provided in the multipole motor, the control unit serving to control the operation of the motor and particularly the electrical commutation of the coil elements. The control unit can be connected, for example, to sensor elements in the turnstile of the revolving door, but can also be connected, for example, to external operators and/or interface modules for controlling the operation of the multipole motor by the control unit integrated in the multipole motor.

According to one aspect, the present invention is further directed to an arrangement of a drive unit in a revolving door, wherein the revolving door has a ceiling element at which the drive unit is arranged and is connected to a turnstile of the revolving door for driving the turnstile, wherein a receiving vessel is provided and is arranged at the underside of the ceiling element, and wherein the drive unit comprises a flat-cylindrical, electronically commutated multipole motor which is inserted into an installation cavity which is formed by a receiving vessel and is open in direction of the installation space of the turnstile. The further features and accompanying advantages of the arrangement already mentioned above in connection with the above-described method are likewise taken into account in the arrangement of the drive unit according to the invention.

In particular, the turnstile can be gearlessly connected to the multipole motor. A retrofitting of a drive unit constructed as multipole motor in a revolving door is first made possible in this way because an installation space for the multipole motor under the ceiling element and above the turnstile is only sufficient when the turnstile can be connected directly to the multipole motor without requiring a gear unit. The direct connection between the turnstile and the multipole motor is formed such that the multipole motor has a rotor part which can be directly connected to the revolving wings of the turnstile, or the multipole motor has an output shaft that can be connected to the revolving wings of the turnstile, for example, by an adapter cross. Consequently, the arrangement of the drive unit can be converted from a drive unit installed above the ceiling element to a drive unit installed below the ceiling element. This affords advantageous possibilities for the remodeling of a facade in which a drive unit arranged above the ceiling element need not be integrated.

In a further advantageous manner, the arrangement can include under ceiling elements which are mounted in a collar-shaped circumferential edge formed integral with the receiving vessel. For this purpose, the receiving vessel can have an insertion opening through which the under ceiling elements can be inserted behind the collar-shaped circumferential edge.

The invention is further directed to a revolving door formed with a drive unit which is constructed as an electronically commutated multipole motor and which has been integrated in an existing revolving door according to the method described above in the course of retrofitting.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein

BRIEF DESCRIPTION OF THE DRAWINGS

In the following, further steps improving the invention are explained in more detail in connection with the description of preferred embodiments of the invention with reference to the drawings. In the drawings.

DETAILED DESCRIPTION OF THE PRESENTLY PREFERRED EMBODIMENTS

Figure 1:
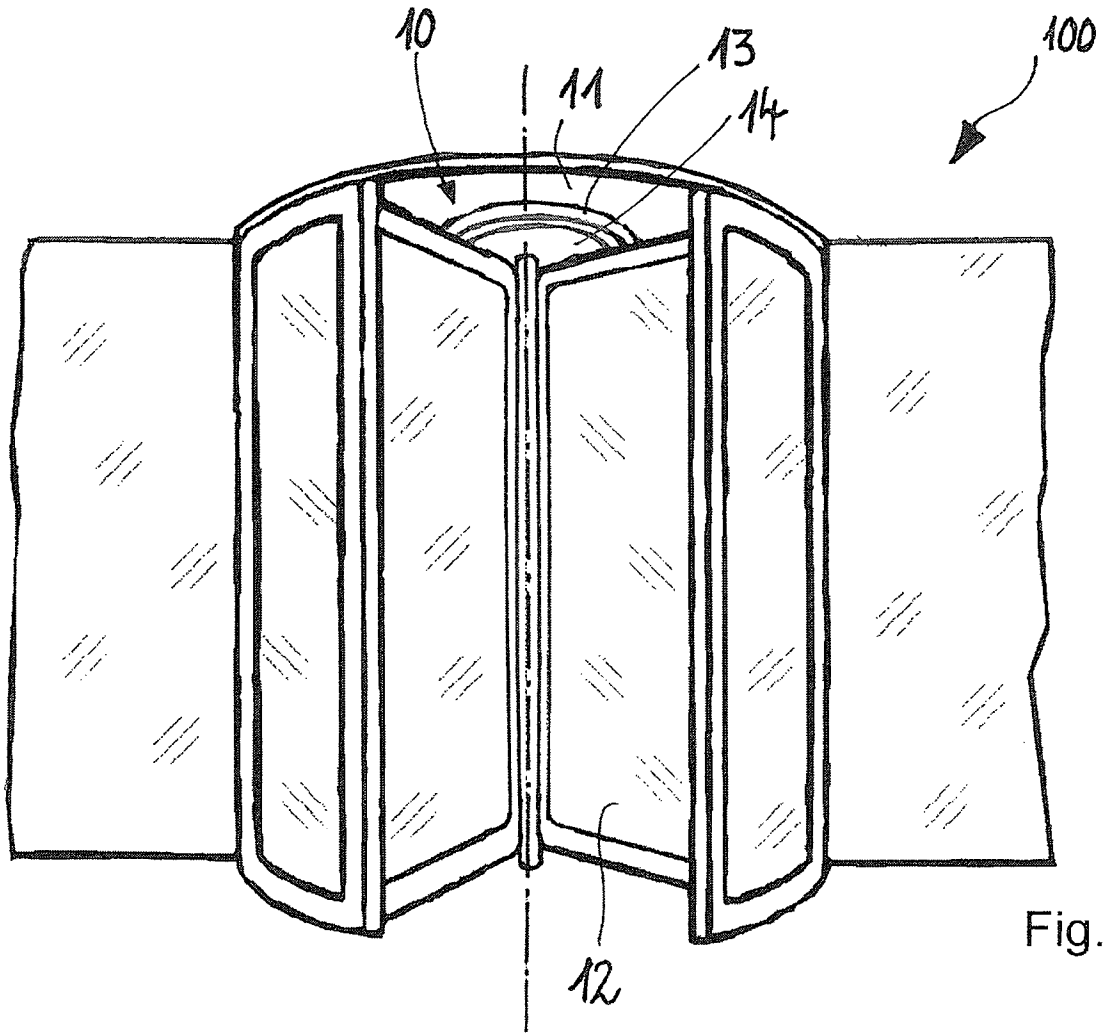
FIG. 1 is a schematic perspective view of a revolving door with a retrofitted drive unit which is arranged at the underside of a ceiling element of the revolving door.

FIG. 1 shows a schematic perspective view of an exemplary embodiment of a revolving door 100 which in the course of retrofitting is outfitted with a drive unit 10 arranged at the underside of a ceiling element 11 of the revolving door 100. The drive unit 10 is connected to a turnstile 12 of the revolving door 100 so that the drive unit 10 is located at the underside of the ceiling element 11 and above the turnstile 12.

The drive unit 10 has a multipole motor 14 which has a flat-cylindrical, dish-shaped form. No further components of the revolving door 100, for example a drive unit 10, are located above the ceiling element 11, and the revolving door 100 can be integrated in a facade predominantly made of glass elements, for example. In particular, the ceiling element 11 of the revolving door 100 can be formed by a glass element, which can likewise be arranged in the frame of the revolving door 100 in the course of retrofitting.

Figure 2:
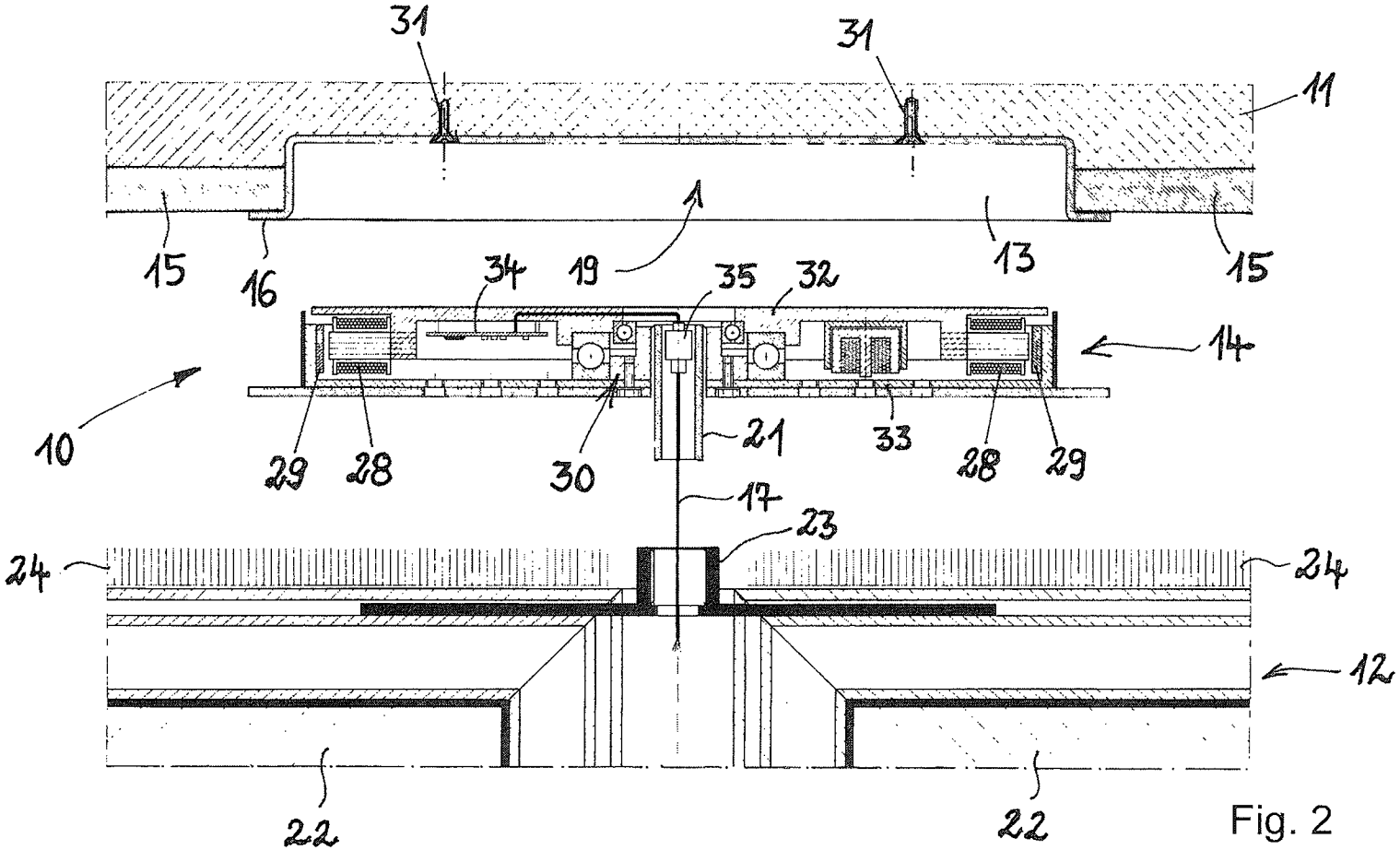
FIG. 2 is a cross-sectional view of the assembly sequence of a multipole motor on the underside of a ceiling element for connecting to the turnstile of a revolving door.

FIG. 2 shows the arrangement of a multipole motor 14 below a ceiling element 11, and a turnstile 12 with two revolving wings 22, for example, below the multipole motor 14. The multipole motor 14 is shown as a flat-cylindrical, dish-shaped constructional unit and forms the drive unit 10 which can be arranged at the revolving door 100 in the course of a retrofit.

The ceiling element 11 is provided at its underside with a cutout in which a receiving vessel 13 is inserted, and the receiving vessel 13 has been screwed into the ceiling element 11 by screw elements 31. The receiving vessel 13 forms an installation cavity 19 dimensioned such that the multipole motor 14 can be inserted into the installation cavity 19.

The receiving vessel 13 has a collar-shaped circumferential edge 16 in which under ceiling elements 15 are mounted. The receiving vessel 13 accordingly assumes the function of forming an installation cavity 19 for receiving the multipole motor 14. Further, the receiving vessel 13 provides for the arrangement of under ceiling elements 15 at the underside of the supporting ceiling element 11.

The multipole motor 14 has a stator part 32 and a rotor part 33, and an output shaft 21 extends from the rotor part 33. The turnstile 12 can be connected to the rotor part 33 of the multipole motor 14 via the output shaft 21 by a cruciform adapter element 23 which serves to receive revolving wings 22 of the turnstile 12. Brush elements 24, which can brush along the under ceiling elements 15 in operation of the turnstile 12, are shown on top of the revolving wings 22.

Installation space receiving coil elements 28, which are fastened to the stator part 32, are formed between the disk-shaped stator part 32 and the cup-shaped rotor part 33. Magnet elements 29, which are located on the outer side with respect to the coil elements 28, are received inside the cup-shaped rotor part 33 so that the multipole motor 14 is formed as an external rotor. The rotor part 33 is rotatably received by a bearing arrangement 30 at the stator part 32 and can accordingly serve at the same time as an upper bearing of the turnstile 12 in the revolving door 100.

A control unit 34 is shown on the inner side between the stator part 32 and the rotor part 33 and is connected to the turnstile 12 by an electric lead 17. A swiveling feedthrough 35 is provided in the electric lead 17 so that the portion of the electric lead 17 below the swiveling feedthrough 35 can rotate along with the turnstile 12 and the portion of the electric lead 17 between the control unit 34 and the swiveling feedthrough 35 is fastened to the stator part 32 in a stationary manner.

Figure 3:
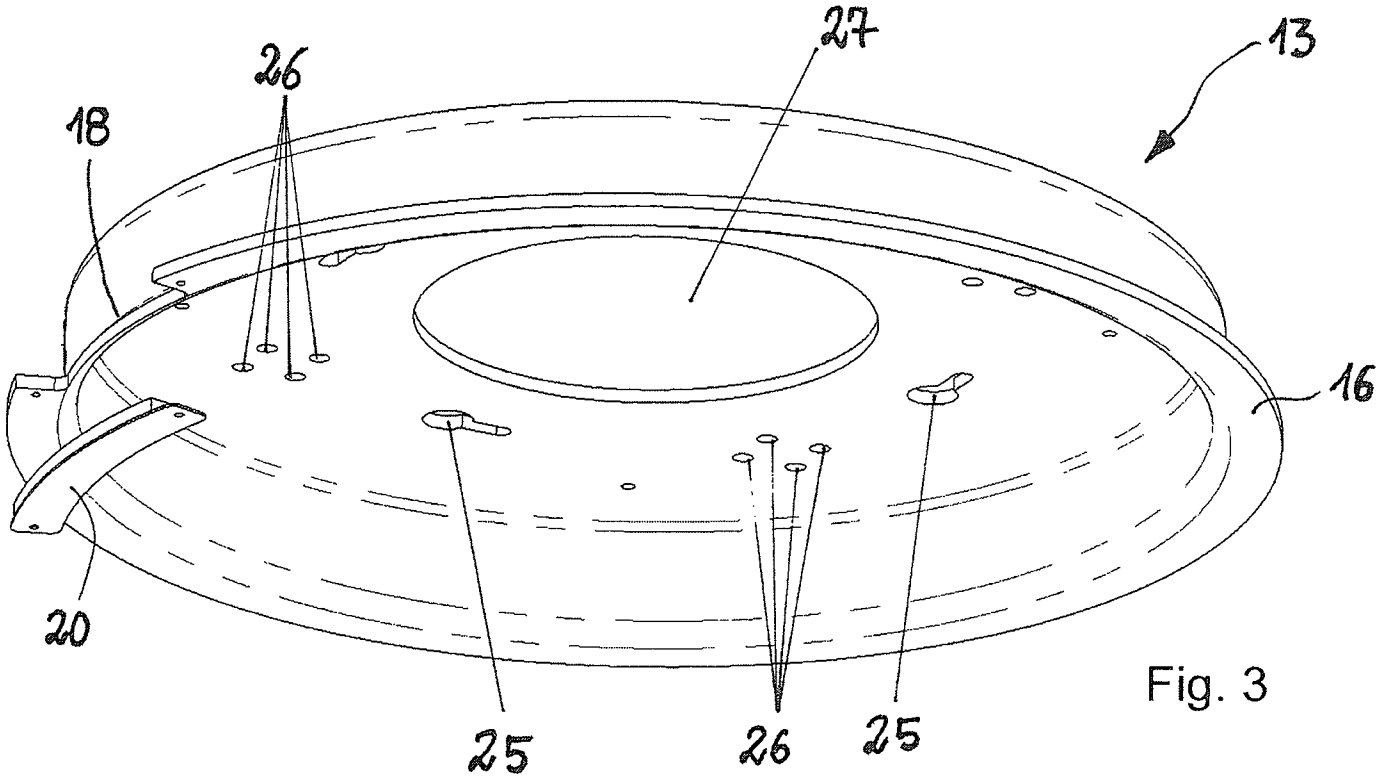
FIG. 3 is a perspective view of the receiving vessel for arranging the multipole motor at the ceiling element.

FIG. 3 shows a perspective view of the receiving vessel 13 by which the multipole motor 14 can be inserted into the revolving door 100 at the underside of the ceiling element 11. The base structure of the receiving vessel 13 is approximately rotationally symmetrical and has a base area in which a base opening 27 is incorporated, for example. Consequently, the receiving vessel 13 can also be constructed annularly without sacrificing its function. Screw holes 26 are located in the base region of the receiving vessel 13 through which the receiving vessel 13 can be fastened to the ceiling element 11 by screw elements 31 shown in FIG. 2. Also shown are receiving openings 25, configured to receive mushroom head-shaped holding elements, for example, which can be arranged at the multipole motor 14 in a manner not shown in more detail. The multipole motor 14 can be secured in the receiving vessel 13 by these elements initially so as to be self-retaining and subsequently with a full retaining function.

The receiving vessel 13 has a collar-shaped circumferential edge 16, an insertion opening 18 being incorporated in the edge 16 as an interruption thereof. Under ceiling elements 15, as shown in FIG. 2, can be inserted through the insertion opening 18. The insertion of the under ceiling elements 15 can be carried out in such a way that they are moved behind the edge 16 and brought into the corresponding position subsequently by rotating around the rotational axis of the turnstile. Subsequently, a cover element 20 can be screwed to the edge of the insertion opening 18 to close the insertion opening 18.

The invention is not limited with respect to its construction to the preferred embodiment example indicated in the preceding. On the contrary, there are a number of conceivable variants which can be made use of by the demonstrated solution also in fundamentally different arrangements. All of the features and/or advantages, including constructional details or spatial arrangements, stemming from the claims, the description or the drawings may be essential to the invention both by themselves and in the most widely varying combinations. In particular, the receiving vessel 13 can also have a different shape which does not need to have an edge. The receiving vessel 13 can also extend in a plane, for example. In particular, the receiving vessel 13 can also be a component part of the multipole motor 14. For example, the receiving vessel 13 can be a part of the stator part 32 of the multipole motor 14.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for installing a drive unit (10) having a disk-shaped, electronically commutated multipole motor (14) in a ceiling element (11) of a revolving door (100), the ceiling element (11) being configured to receive and engage the drive unit (10), the drive unit (10) being configured to drive a turnstile (12) of the revolving door (100), the method comprising:

providing a receiving vessel (13) at an underside of the ceiling element (11) so as to form, at the underside of the ceiling element (11), an installation cavity (19) opening in a direction of the turnstile (12), the receiving vessel (13) having an annular flange (16) integrally formed around a circumferential edge of the receiving vessel (13);

engagedly inserting the disk-shaped, electronically commutated multipole motor (14) into the installation cavity (19) to form the drive unit (10); and securing under ceiling elements (15) to the underside of the ceiling element (11) by connecting the under ceiling elements (15) to the annular flange (16) of the receiving vessel (13).

2. The method according to claim 1, further comprising engaging the turnstile (12) with the multipole motor (14).

3. The method according to claim 1, further comprising connecting at least one electric lead (17) to the turnstile (12).

4. A system in which a drive unit (10) is installed in a revolving door (100), the revolving door (100) having a ceiling element (11) configured to receive and engage the drive unit (10), the drive unit being connected to a turnstile (12) of the revolving door (100) for driving the turnstile (12), the system comprising:

a receiving vessel (13) arranged at the underside of the ceiling element (11), the receiving vessel (13) having an installation cavity open in a direction of the turnstile (12), the receiving vessel (13) having an annular flange (16) integrally formed around a circumferential edge of the receiving vessel(13);

under ceiling elements (15) configured so as to be engagable with the annular flange (16); and the drive unit (10), the drive unit (10) having a disk-shaped, electronically commutated multipole motor (14) configured so as to be insertable into the installation cavity of the receiving vessel (13).

5. The system according to claim 4, wherein the turnstile (12) is gearlessly connected to the multipole motor (14).

6. The system according to claim 4, wherein annular flange (16) has an insertion opening (18) through which the under ceiling elements (15) are insertable behind the annular flange (16).

* * * * *